United States Patent [19]

Nagy

[11] Patent Number: 4,817,832

[45] Date of Patent: Apr. 4, 1989

[54] TELESCOPING NOZZLE ASSEMBLY

[76] Inventor: Joan M. Nagy, 1102 Elwell St., Pittsburgh, Pa. 15207

[21] Appl. No.: 95,412

[22] Filed: Sep. 10, 1987

[51] Int. Cl.[4] ..... B67D 5/37

[52] U.S. Cl. ..... 222/530; 222/529

[58] Field of Search ..... 222/526–527, 222/529–530, 538, 540, 490; 138/119, 132–133; 220/85 SP

[56] References Cited

U.S. PATENT DOCUMENTS

| | | | |
|---|---|---|---|
| 2,852,216 | 9/1958 | Peters | 222/530 X |
| 3,093,273 | 6/1963 | Borah | 222/530 X |
| 3,558,022 | 1/1971 | Zytko | 222/490 |
| 3,785,538 | 1/1974 | Cocozella | 222/490 |
| 4,492,324 | 1/1985 | Weber | 222/529 |
| 4,529,108 | 7/1985 | Chlystun | 222/529 |
| 4,560,081 | 12/1985 | Adams | 220/85 SP |

FOREIGN PATENT DOCUMENTS

| | | | |
|---|---|---|---|
| 148592 | 8/1920 | United Kingdom | 222/530 |

*Primary Examiner*—Michael S. Huppert
*Attorney, Agent, or Firm*—Stanley J. Price, Jr.

[57] ABSTRACT

A telescoping nozzle assembly adapted to be secured to the pouring opening of a container to facilitate pouring of fluid from the container includes a base member adapted to be received in the container pouring opening. A helically formed member is provided having an end portion secured to the base member and an opposite end portion shaped in the form of a pull-tab member. The helically formed member is extendible from a normally collapsed helical condition within the container pouring opening to an elongated helical condition. A resilient covering surrounds the helically formed member and is extendible with the helically formed member from the normally collapsed helical condition to the elongated helical condition. The resilient covering has a bottom surface portion sealingly connected with the base member, and an open top surface portion which defines a generally circular opening in the resilient covering. In order to dispense fluid from the container through the telescoping nozzle assembly, the pull-tab member is grasped and pulled in a direction away from the pouring opening in the container to extend the helically formed member and resilient covering from the normally collapsed helical condition to the elongated helical condition. Extending the helically formed member and resilient covering forms a hollow interior portion within the resilient covering through which fluid is dispensed. After pouring is completed, the pull-tab member is released to allow the helically formed member and resilient covering to automatically collapse into the container pouring opening.

8 Claims, 1 Drawing Sheet

TELESCOPING NOZZLE ASSEMBLY

BACKGROUND OF THE INVENTION

1. Field of The Invention

This invention relates to a pouring nozzle, and more particularly, to a resilient nozzle assembly which may be secured over the pouring opening of a container and extended outwardly from the pouring opening to facilitate the dispensing of fluid from the container.

2. Description of The Prior Art

In well known that bottles or containers provide a convenient means for storing and dispensing fluids. Normally, bottles or containers are provided with a neck having a pouring opening through which the fluid within the bottle or container is dispensed. In order to dispense fluid from the container, the cap or lid which seals the container is removed, and the container is inverted to allow the fluid within the container to flow through the pouring opening.

However, it is often the case that the configuration of the container neck and the receptacle into which the fluid is to be poured makes dispensing the fluid into the receptacle a difficult task. For example, if it is desired to refill the windshield washer fluid receptacle on many automobiles, the windshield washer fluid receptacle cap is removed and a container of windshield washer fluid is inverted over the opening in the receptacle to pour the fluid from the container into the receptacle. Normally however, due to the configuration of the neck of the windshield washer fluid container and the location of the opening in the windshield washer fluid receptacle, the pouring opening in the container can not be positioned sufficiently close to the opening in the receptacle to easily pour the fluid into the opening. As a result, windshield washer fluid is spilled over the receptacle and lost. In order to prevent spillage, it is necessary to insert a funnel into the receptacle opening to receive the windshield washer fluid dispensed from the container.

In order to alleviate the spillage problems normally associated with dispensing fluids from bottles or containers, containers having built-in pouring spouts have been employed.

U.S. Pat. No. 1,190,612 discloses a box or can made from metal, paper, cardboard or the like having a nozzle built into the top section of the box. The nozzle is corrugated so that it may be folded in such position that the top nozzle is below the level of the top of the box. In an extended position, the nozzle is above the level of the top of the box and forms a pouring spout.

U.S. Pat. No. 2,561,596 discloses an extensible and contractible flexible pouring spout nestable in a container. The flexible collapsed spout is normally nested wholly within the container and is extensible from the container for pouring purposes.

U.S. Pat. No. 3,042,271 discloses a semi-rigid flexible plastic spout retractable into and projectable out of a plastic container. U.S. Pat. No. 3,093,273 discloses a pouring spout for conventional liquid containers which can be attached to and detached from the container by hand. The flexible spout may be folded into the container opening and the opening capped when the spout is not in use.

U.S. Pat. No. 3,298,577 discloses a collapsible pouring spout for use with a container. The pouring spout is normally recessed within the container, and includes a pull member or tab opening device which, when pulled, extends the pouring spout from the container.

U.S. Pat. No. 3,401,851 discloses a dispensing closure attached to the discharge opening of a container to provide a discharge nozzle of desired length which is concealed within the discharge opening during shipping. The discharge nozzle is made of rubber or like elastic material, and has one or more weakened areas that can be broken off at a desired weakened area to form a nozzle of desired length.

U.S. Pat. No. 4,442,949 discloses a nestable spout assembly for dispensing liquid products from containers. In an extended position the plastic spout has an enlarged flexible lower portion joined to a relatively rigid externally threaded upper wall portion. A peripheral sealing channel is disposed about the base of the lower wall portion for securing the spout assembly to a container by means of an overlying metal crimping ring. A tear out diaphragm is recessed within the upper end of the spout and is provided with an integrally molded ring pull for removal.

U.S. Pat. No. 4,589,578 discloses a disposable pouring spout for use with a container. The spout consists of an elongated, tubular element which is initially folded upon itself into a tight roll and secured over the container opening. The upper end of the spout is moved up and away from the container upon upward lifting of a pull-tab to open the entire spout to the container interior for dispensing material therefrom.

U.S. Pat. No. 4,602,728 discloses a container having a neck adapted to assume a collapsed position and to be extended in telescopic fashion to an extended position for dispensing fluid from the container. The end of the neck is threaded to receive a sealing cap having a lift-up loop to pull the neck from its collapsed position.

While the prior art devices all disclose various types of pouring spouts which maybe connected to a bottle or container, there is a need for an improved pouring nozzle with may be positioned in a collapsed condition within the pouring opening of a bottle or container and extended outwardly from the pouring opening when it is desired to dispense fluid from the container. The improved nozzle is made from resilient materials to allow the nozzle to resume its collapsed condition within the pouring opening of the bottle or container after use. In a collapsed condition, the pouring nozzle folds to a substantially flat configuration to allow a sealing lid or cap to be secured to the container.

SUMMARY OF THE INVENTION

In accordance with the present invention there is provided a telescoping nozzle assembly for dispensing fluid from a container that includes a generally circular base member having an opening therethrough and adapted to be secured over a pouring opening in a container. Resilient means is also provided having an end portion connected with the base means and an opposite end portion. The resilient means is extendible from a normally collapsed helical condition within the circular base means to an elongated helical condition. The resilient means forms a hollow interior portion fluidly connected with the opening in the base means and the pouring opening the container when extended to an elongated helical condition.

A resilient covering is provided which surrounds the resilient means. The resilient covering is extendible with the resilient means from the normally collapsed helical condition to the enlongated helical condition. The resilient covering has a bottom surface portion sealingly connected with the base means and a top surface portion defining a generally circular opening in the resilient covering. Tab means connected with the resilient means opposite end portion has a free end portion adapted to be grasped and pulled in a direction away from the pouring opening in the container to extend the resilient means and resilient covering from the normally collapsed helical condition to the elongated helical condition. When in an elongated helical condition, the resilient means and resilient covering form a hollow interior portion fluidly connected with the pouring opening in the container to allow fluid to flow from the container through the hollow interior portion and be discharged through the circular opening in the resilient covering.

Accordingly, the principle object of the present invention is to provide a telescoping nozzle assembly for use with a bottle or container to facilitate pouring of fluid from the bottle or container.

Another object of the present invention is to provide a removable nozzle assembly which may be secured over the pouring opening of a bottle or container and extended outwardly from the bottle or container to form a flow path for fluid discharged from the bottle or container.

An additional object of the present invention is to provide a removable nozzle assembly made from resilient materials which may be secured over the pouring opening of a container and extended outwardly from the pouring opening when it is desired to dispense fluid from the container and which will automatically collapse into the pouring opening of the container when not in use.

These and other objects of the present invention will be more completely disclosed and described in the following specification, the accompanying drawings and the appended claims.

DESCRIPTION OF THE PREFERRED EMBODIMENTS

Figure 1:
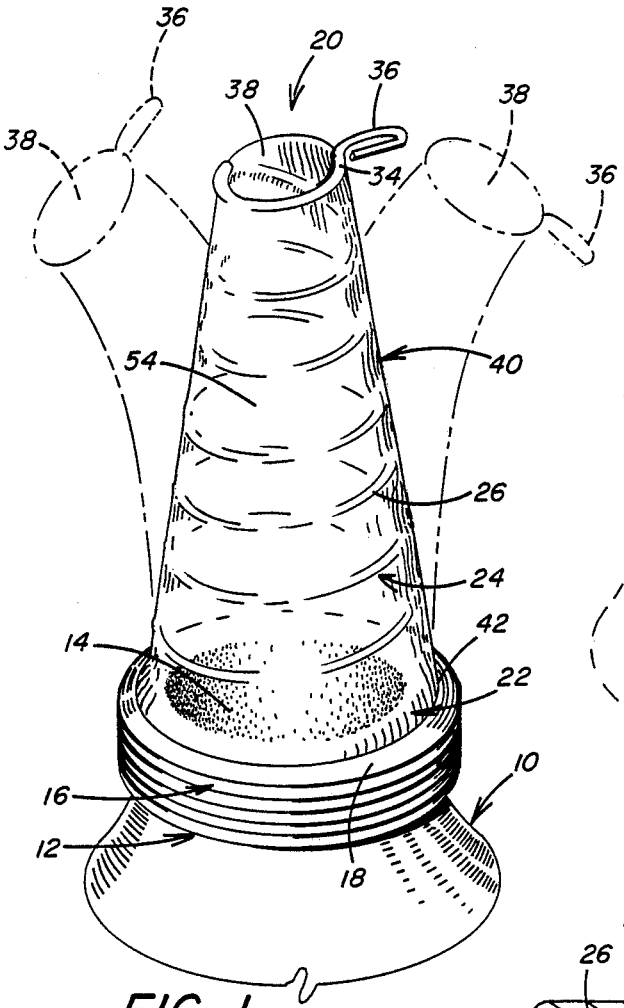
FIG. 1 is a perspective view of a telescoping nozzle assembly for use with a bottle or container, illustrating the telescoping nozzle assembly connected with the pouring opening of the bottle or container and extended to its elongated helical condition.
Figure 2:
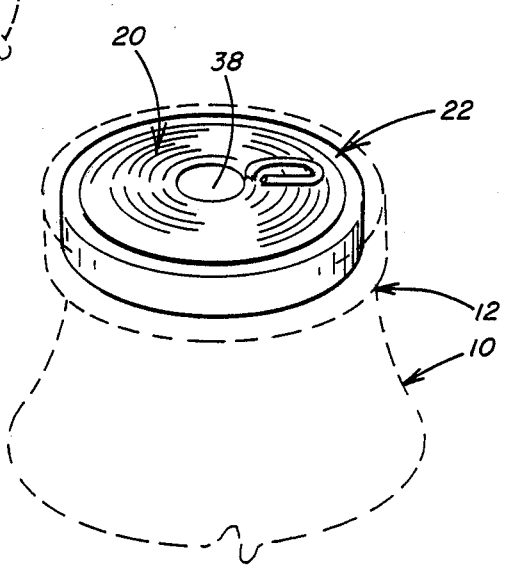
FIG. 2 is a perspective view of the telescoping nozzle assembly of FIG. 1, illustrating the telescoping nozzle assembly in its normally collapsed helical condition within a pouring opening of a bottle or container.

Referring to the drawings, and particularly to FIGS. 1 and 2, there is illustrated a bottle or container 10 for use in storing and dispensing various types of fluids. Bottle or container 10 is itself known in the art and is described herein only as it relates to the present invention. Bottle or container 10 may be made from a glass or plastic material, or suitable metallic material. Bottle or container 10 includes a neck portion 12 arranged to form a pouring opening 14 through which fluid stored within container 10 is dispensed as needed. Typically, the neck portion 12 of container 10 includes a threaded portion 16 for receiving a cap or lid for sealing the pouring opening 14. As is well known in the art, when it is desired to dispense a fluid from bottle or container 10, the cap or lid is first removed from container 10, and container 10 is inverted to allow fluid to flow through pouring opening 14.

There are many instances when the specific design of container 10 and especially neck portion 12 make it difficult to efficiently dispense fluid from the container. For example, container 10 may be filled with a windshield washer fluid. If it is desired to fill the windshield washer fluid reservoir located in an automobile engine compartment, the lid or cap is removed from container 10, and container 10 is inverted over the opening in the windshield washer fluid reservoir. However, once container 10 is inverted the windshield washer fluid necessarily begins to flow through pouring opening 14. This flow may occur before the pouring opening 14 of container 10 is suitably positioned over the opening in the windshield washer fluid reservoir causing the fluid to be spilled throughout the engine compartment.

In order to alleviate the spillage problems encountered in dispensing a fluid from bottle or container 10, a telescoping nozzle assembly generally designated by the numeral 20 is utilized. Telescoping nozzle assembly 20 is illustrated in FIG. 2 in its normally collapsed condition, and is illustrated in an extended or elongated condition in FIG. 1. Telescoping nozzle assembly 20 is operable in its extended or elongated condition to direct the flow of fluid passed through pouring opening 14 of container 10 and eliminate the spillage problems normally associated with dispensing fluid through the pouring opening 14 of container 10.

As seen in FIGS. 1 and 2, telescoping nozzle assembly 20 is designed to be inserted into the pouring opening 14 of container 10 and extended to its elongated condition when it is desired to dispense fluid from container 10. Although telescoping nozzle assembly 20 illustrated in FIGS. 1 and 2 is positioned within the pouring opening 4 of container 10, it should be understood that telescoping nozzle assembly 20 may also be designed to be received by the threaded neck portion 16 of bottle or container 10 if desired. Since telescoping nozzle 20 is an assembly separate from bottle or container 10, it is seen that telescoping nozzle assembly 20 may be removed from the pouring opening 14 of container 10 after all of the fluid in container 10 is dispensed and reused as needed.

As previously described, telescoping nozzle assembly 20 is illustrated in its normally collapsed condition in FIG. 2 and in its extended or elongated condition in FIG. 1. As will be described later in greater detail, telescoping nozzle assembly 20 is made from flexible materials to permit the pouring opening in telescoping nozzle assembly 20 to be extended from the top portion 18 of container neck 12 by a preselected distance. In addition, the flexible materials of telescoping nozzle assembly 20 allow the nozzle assembly to be positioned as desired when in an extended or elongated condition. Two such nozzle assembly positions are illustrated in phantom in FIG. 1.

Figure 4:
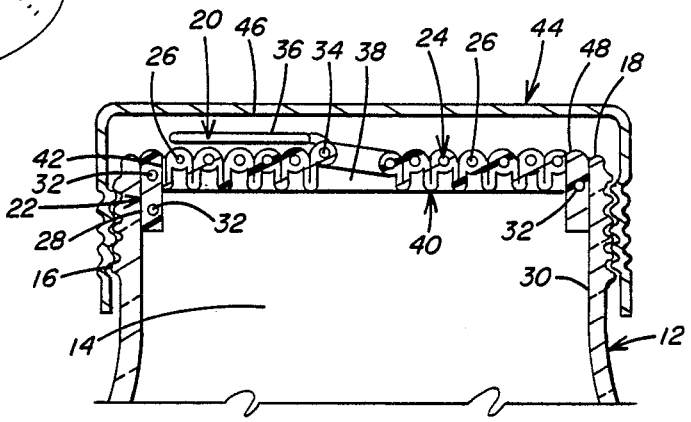
FIG. 4 is a sectional view of the telescoping nozzle assembly of FIGS. 1 and 2 in its normally collapsed helical condition and positioned within the pouring opening of a bottle or container.

Referring to FIGS. 1 and 4, telescoping nozzle assembly 20 includes a base member 22 and a helically formed member 24. Helically formed member 24 may be made from any suitable resilient material, such as spring steel or suitable plastic material. Helically formed member 24 is designed to take the shape of a conical helix when in an extended or elongated condition as illustrated in FIG. 1. The conical helical configuration of helically formed member 24 permits the individual wraps or turns 26 which make up helically formed member 24 to maintain the normally collapsed helical condition illustrated in FIG. 4 when the nozzle assembly is not in use.

Base member 22 is generally circular in shape and has an annular configuration. Base member 22 has a generally circular outside wall 28, and the diameter of base member 22 outside wall 28 is substantially identical to the diameter of the generally circular inside wall 30 of container 10 neck portion 12. Since the diameter of base member 22 outside wall 28 is substantially identical to the diameter of inside wall 30, it is seen that base member 22 of telescoping nozzle assembly 20 may be inserted into pouring opening 14 and maintained in frictional engagement with the inside wall 30 of container 10. The frictional engagement between base member 22 outside wall 28 and the inside wall 30 of neck portion 12 maintains telescoping nozzle assembly 20 secured within pouring opening 14 when telescoping nozzle assembly 20 is extended to its elongated condition and fluid is dispensed from bottle or container 10.

Telescoping nozzle assembly 20 includes a helically formed member 24 which has an end portion 32 embedded in base member 22 to connect helically formed member 24 with base member 22. As seen in FIG. 4, approximately one and one-half wraps or turns 26 of helically formed member 24 are embedded in base member 22. Although helically formed member 24 may be connected to base member 22 as illustrated in FIG. 4, it should be understood that helically formed member 24 may be connected with base member 22 by any suitable means.

As seen in FIGS. 1 and 4, helically formed member 24 includes an opposite end portion or free end portion 34 which is positioned in substantially the center of container 10 pouring opening 14 when helically formed member 24 is in its normally collapsed helical condition. The opposite end portion or free end portion 34 of helically formed member 24 is shaped by suitable means to form pull-tab member 36. Pull-tab member 36 can have any desired shape and is designed to be easily grasped. Opposite end portion 34 of helically formed member 24 is shaped so that pull-tab member 36 extends downwardly or away from the pouring opening 38 in telescoping nozzle assembly 20. When it is desired to dispense fluid from bottle or container 10 through telescoping nozzle assembly 20, pull-tab member 36 is grasped and pulled in a direction away from top portion 18 of container neck 12 to extend helically formed member 24 from its normally collapsed condition illustrated in FIGS. 2 and 4 to its elongated helical condition illustrated in FIG. 1. Since helically formed member 24 is made from a resilient material such as spring steel or other suitable resilient plastic material, it is seen that after pull-tab member 36 is grasped and pulled in a direction away from top portion 18 of container neck portion 12 to extend helically formed member 24 to its elongated helical condition, releasing pull-tab member 36 will cause helically formed member 24 to automatically collapse and resume its normally collapsed condition as illustrated in FIGS. 2 and 4.

As seen in FIGS. 1 and 4, telescoping nozzle assembly 20 also includes a resilient covering 40. Resilient covering 40 may be made from any suitable material, such as a latex rubber material, which is capable of stretching with helically formed member 24 as helically formed member 24 is extended from it normally collapsed helical condition to its elongated helical condition. In addition, the material from which resilient covering 40 is made must be capable of resuming its original shape after nozzle 20 is extended for pouring purposes and thereafter collapsed within container neck portion 12 after pouring is completed.

Resilient covering 40 is secured to helically formed member 24 and completely surrounds helically formed member 24 to provide a sealed flow passage for fluid passed through telescoping nozzle assembly 20 from container 10 pouring opening 14 to pouring opening 38 in resilient covering 40. Resilient covering 40 has a generally circular bottom surface portion 42 sealingly connected to base member 22. The generally circular bottom surface portion 42 of resilient covering 40 is sealingly connected to base member 22 to prevent fluid from leaking between base member 22 and resilient covering 40 as bottle or container 10 is inverted to dispense fluid through pouring opening 38 in resilient covering 40.

Resilient covering 40 is secured to helically formed member 24 to provide that the portions of the resilient covering extending between adjacent individual wraps or turns 26 fold over on themselves as illustrated in FIG. 4 when telescoping nozzle assembly 20 is in its normally collapsed helical condition. Since helically formed member 24 and covering 40 are made from resilient materials, it is seen in FIG. 4 that when telescoping nozzle assembly 20 is not in use, telescoping nozzle assembly 20 remains collapsed within pouring opening 14 to permit a cap or lid 44 to be threadedly secured to the threaded portion 16 of neck 12 and seal the contents of container 10. Since pull-tab member 36 is positioned above a portion of the individual wraps or turns 26 when helically formed member 24 is in its normally collapsed condition, rotation of cap or lid 44 to seal the contents of container 10 will cause the inside wall 46 of cap or lid 44 to initially contact pull-tab member 36. Continued rotation of cap or lid 44 in a tightening direction will cause helically formed member 24 and resilient covering 40 to flex in a downward direction within pouring opening 14 until inside wall 46 of cap or lid 44 sealingly contacts top portion 18 of container 10.

The flexible materials of telescoping nozzle assembly 20 permit telescoping nozzle assembly 20 to be inserted in the pouring opening 14 of container 10 and, when in a normally collapsed condition, permit cap or lid 44 to sealingly contact either the top portion 18 of container 10 or the top wall 48 of base member 22. Since telescoping nozzle assembly 20 is made from flexible materials, the exact positioning of base member 22 in pouring opening 14 is not critical and bottle or container 10 may be sealed by threading cap or lid 44 on the threaded portion 16 of neck 12 until the inside wall 46 of cap or lid 44 contacts either the top portion 18 of container 10 or top wall 48 of base member 22.

Figure 3:
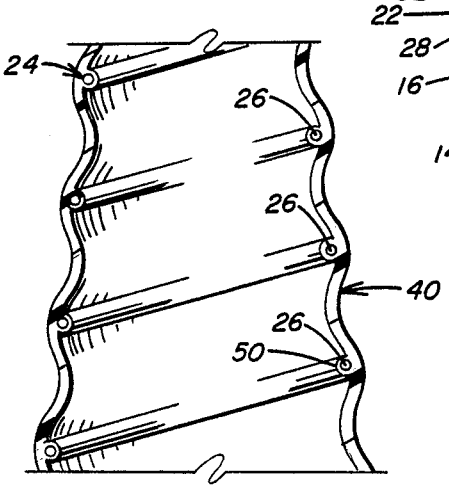
FIG. 3 is a sectional view of a portion of the telescoping nozzle assembly of FIG. 1, illustrating a resilient covering secured to a helically formed member which forms a part of the nozzle assembly.
Figure 5:
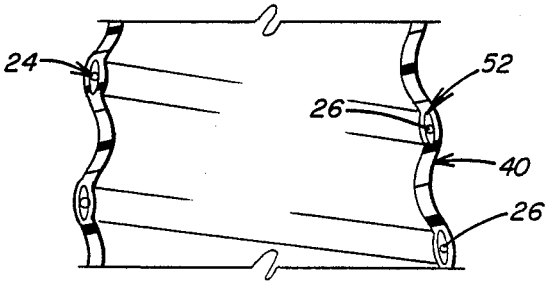
FIG. 5 is a sectional view of a portion of the telescoping nozzle assembly of FIG. 1, illustrating an alternate method for securing the resilient covering to the helically formed member.

Referring to FIGS. 3 and 5, there are illustrated two alternate methods for connecting resilient covering 40 to helically formed member 24. Although FIGS. 3 and 5 illustrate two alternate methods for connecting resilient covering 40 to helically formed member 24, it should be understood that any suitable means for connecting or securing resilient covering 40 to helically formed member 24 may be utilized without departing from this invention.

Referring to FIG. 3, there is illustrated a portion of helically formed member 24 having a plurality of individual wraps or turns 26. Resilient covering 40 may be molded or formed by any suitable means known in the art to provide a helically formed pocket 50 for receiving the individual wraps or turns 26. The individual wraps 26 are secured within helically extending pocket 50 to allow resilient covering 40 to extend with helically formed member 24 from a normally collapsed helical condition to an elongated helical condition.

FIG. 5 illustrates a second method for securing resilient covering 40 to helically formed member 24. As seen in FIG. 5, resilient covering 40 may be molded or formed by any suitable means known in the art to include a helically extending pocket 52. The individual wraps or turns 26 of helically formed member 24 are positioned in helically extending pocket 52 to provide that, as pull-tab member 36 is extended outwardly in a direction away from container 10 top portion 18, resilient covering 40 is also extended.

As described herein, telescoping nozzle assembly 20 may be secured over a pouring opening 14 in a bottle or container 10 and extended from its normally collapsed helical condition to an elongated helical condition to form a hollow interior portion fluidly connected with pouring opening 14 in container 10. After telescoping nozzle assembly 20 is extended, container 10 may be inverted to dispense fluid through the pouring opening 38 in nozzle assembly 20. Since telescoping nozzle assembly 20 is removably connected to container 10, telescoping nozzle assembly 20 may be removed from container 10 after container 10 is emptied and saved for reuse. The resilient materials from which telescoping nozzle assembly 20 is made allow the pouring opening 38 in telescoping nozzle assembly 20 to be positioned at any desired location when in an elongated helical condition to facilitate pouring of fluid from container 10.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated in and described herein.

I claim:

1. A telescoping nozzle assembly for dispensing fluid from a container comprising, base means having an opening therethrough and adapted to be secured over a pouring opening in a container, resilient means having an end portion connected with said base means and an opposite end portion, said resilient means having a normally collapsed helical position adjacent said pouring opening of said container, said resilient means extendable to an extended elongated helical position; said resilient means being biased toward a collapsed helical position;

said resilient means having a hollow interior portion when in said elongated helical position fluidly connected with said opening in said base means, a resilient covering surrounding said resilient means and extendable with said resilient means from said normally collapsed helical position to said elongated helical position, said resilient covering having a bottom surface portion sealingly connected with said base means and a top surface portion defining a generally circular opening in said resilient covering, and tab means on said resilient means opposite end portion, said tab means having a free end portion adapted to be grasped and pulled in a direction away from said pouring opening in said container to extend said resilient means and said resilient covering away from said normally collapsed helical position to said elongated helical position.

2. A telescoping nozzle assembly for dispensing fluid from a container as set forth in claim 1 in which, said resilient means has a conical helical configuration when extended to said elongated helical position.

3. A telescoping nozzle assembly for dispensing fluid from a container as set forth in claim 1 in which, a portion of said resilient means end portion is embedded in said base means to connect said resilient means with said base means.

4. A telescoping nozzle assembly for dispensing fluid from a container as set forth in claim 1 in which, said pouring opening in said container is arranged to define a generally circular inside wall portion of preselected diameter, said base means has a generally annular configuration with an outside wall portion of said base means having a diameter substantially equal to said preselected diameter of said pouring opening inside wall portion, and said base means is maintained in position within said pouring opening by frictional engagement between said base means outside wall portion and said pouring opening inside wall portion.

5. A telescoping nozzle assembly for dispensing fluid from a container as set forth in claim 1 in which, said container has an externally threaded neck portion arranged to form said pouring opening, said base means has a generally annular configuration with an inside wall portion of said base means threaded to mate with said container externally threaded neck portion, and said base means is threadedly connected with said container externally threaded neck portion.

6. A telescoping nozzle assembly for dispensing fluid from a container as set forth in claim 1 in which, said resilient means is formed from a helically wound spring steel material.

7. A telescoping nozzle assembly for dispensing fluid from a container as set forth in claim 1 in which, said resilient covering is formed from a latex material.

8. A telescoping nozzle assembly for dispensing fluid from a container as set forth in claim 1 in which, a portion of said resilient means opposite end portion forming said tab means.

* * * * *